US006742555B2

(12) United States Patent
Degen et al.

(10) Patent No.: US 6,742,555 B2
(45) Date of Patent: Jun. 1, 2004

(54) DEVICE AND METHOD FOR PRODUCING COLUMNS OF MATERIALS IN THE GROUND OF BODIES OF WATER

(75) Inventors: Alexander Degen, Schwindegg (DE); Wilhelm Degen, Irvine, CA (US)

(73) Assignee: Vibroflotation B.V. (NL)

( * ) Notice: Subject to any disclaimer, the term of this patent is extended or adjusted under 35 U.S.C. 154(b) by 0 days.

(21) Appl. No.: 10/415,282

(22) PCT Filed: Oct. 26, 2001

(86) PCT No.: PCT/EP01/12456

§ 371 (c)(1),
(2), (4) Date: Nov. 10, 2003

(87) PCT Pub. No.: WO02/35013

PCT Pub. Date: May 2, 2002

(65) Prior Publication Data

US 2004/0074560 A1 Apr. 22, 2004

(30) Foreign Application Priority Data

Oct. 27, 2000 (DE) ..... 100 53 427

(51) Int. Cl.[7] ..... B65B 1/04

(52) U.S. Cl. ..... 141/301; 141/9; 141/100; 141/72; 405/232; 405/256

(58) Field of Search ..... 141/301, 302, 141/9, 100, 104, 71, 72; 405/231–233, 240, 247, 249, 256, 257

(56) References Cited

U.S. PATENT DOCUMENTS 6,517,292 B1 * 2/2003 Landau ..... 405/233
6,588,987 B1 * 7/2003 Degen et al. ..... 405/271

* cited by examiner

*Primary Examiner*—Steven O. Douglas
(74) *Attorney, Agent, or Firm*—Pendorf & Cutliff

(57) ABSTRACT

The invention relates to a device for producing columns of material in the ground, especially in the ground under bodies of water, comprising the following: a first material tank (8) and a second material tank (10) connected to the first tank; a deep vibrator element (11) connected to the second material tank (10), a first supply lane (5) connected to the first material tank (8) and used to supply material; a second supply line (6) connected to the first material tank (8) and used to equalize pressure in the first material tank (8). The invention also relates to the production of a column of material in the ground.

20 Claims, 4 Drawing Sheets

DEVICE AND METHOD FOR PRODUCING COLUMNS OF MATERIALS IN THE GROUND OF BODIES OF WATER

CROSS REFERENCE TO RELATED APPLICATION

This application is a national stage of PCT/EP01/12456 filed Oct. 26, 2001 and based upon DE 100 53 427.9 filed Oct. 27, 2000 under the International Convention.

BACKGROUND OF THE INVENTION

1. Field of the Invention

The present invention concerns a device for producing columns of material in the ground, in particular under water, for example on the sea floor.

2. Description of the Related Art

A device with a deep vibrator for producing columns of material in the ground is known for example from DE 197 07 687 C1.

Further, in DE 198 14 021 A1 a device for producing columns of material in the ground is described, which includes a deep vibrator and an extension pipe connected to the deep vibrator, which can be acted upon with pressure. Connected to the upper end of the extension pipe is a lock or charge chamber, with a first closure mechanism provided between the charge chamber and the extension pipe, and a second closure mechanism on the side opposite the extension pipe. In the known device the material to be introduced into the ground, for example concrete or gravel, enters via the second closure mechanism into the first charge chamber, from where, with closed second closure mechanism and open first closure mechanism, it enters into the extension pipe which is under pressure. The pressure in the extension pipe serves to overcome the water pressure at the tip of the deep vibrator and thereby to extrude material at the vibrator tip. This type of deep vibrator is referred to as a charge chamber vibrator.

SUMMARY OF THE INVENTION

The present invention is concerned with the task of providing a device for producing columns of material in the ground of bodies of water, in particular under bodies of water of great depth.

This task is solved by a device having the characterizing features of claim 1. Advantageous embodiments of the invention are set forth in the dependent claims.

The inventive device includes first and second material tanks, which are connected with each other, and a deep vibrator for introduction of material into the ground, which is connected with the second material tank. A first closure means is provided between the first and second material tanks. A first supply line is connected to the first material tank for supply of material and a second supply line or as the case may be a pressure equalizing line is connected to the first material tank for equalizing pressure in the first material tank.

During the introduction of material columns into the ground of bodies of water the deep vibrator and the first and second material tanks are under water, they are thus under a pressure which is greater than the atmospheric pressure at the water surface. The first supply line serves for conveying the material to be introduced into the ground from a reservoir at the surface of the water, for example from a ship, under pressure into the first material tank. The second line or hose, which preferably likewise leads up to the surface of the water, enables a pressure equalization between the pressure at the water surface and the first material tank. The pressure in the first supply line for supplying the material, for example gravel or concrete, must thus be selected to be sufficiently high in order that the material is conveyed with sufficient flow velocity at atmospheric pressure. This pressure conventionally is less than 7.5 bar. The ambient pressure in the water in the environment of the first material tank is at the same time substantial.

The pressure equalization in the first material tank by means of the second line has as a consequence that for the first supply line for supplying material to the first material tank, which is now at atmospheric pressure, a hose can be employed which is designed merely for the same pressures used for conveying of material on land. There is no need for incurring the cost of expensive special hoses, which are designed for high pressure.

Floats are preferably provided in the area of the end of the second supply line opposite to the first material tank in order to keep that end of the line on the surface of the water.

In order to prevent the high pressure, which exists in the second material tank during the operation thereof as necessary for introduction of the material to the floor, from being lost via the pressure equalizing line during opening of the first closure means, at least one additional closure means is preferably provided, which is located between the first and second supply lines and at least one area of the first material tank.

In a further preferred embodiment second and third closure means are provided between the first supply line and the first material tank and between the second supply line and the first material tank, which are respectively opened when material is supplied via the first supply line to the first material tank. When the second and third closure means are closed, the first closure means between the first and second material tanks can be opened, whereupon the material can be supplied to the deep vibrator conventionally via a pipe extending into the depth. A compressor is preferably connected to the second material tank in order to build up pressure in the second material tank which is greater than the water pressure at the tip of the deep vibrator, whereby the material can be extruded at the tip of the deep vibrator. The closing of the second and third closure means during opening of the first closure means brings about that the pressure in the second material tank remains established—a pressure equalization occurs only within the limited volume of the first chamber—so that no dirt out of the ground, in which the tip of the deep vibrator is located, is sucked in.

According to a further embodiment of the invention it is proposed that the compressor is also connected to the first material tank, whereby the pressure can remain established in the first material tank following the closing of the first and second closure means, which pressure corresponds to the pressure in the second material tank. The seating of the first closure means between the first and second material tanks, and which may be for example be a slide valve, is thereby unburdened during the opening of the first closure means. This is in particular useful and sometimes necessary, when work has been carried out at great depth and a corresponding great pressure is necessary in the second material tank for extrusion of the material.

In a further embodiment it is envisioned that the first material tank includes a first chamber, in which the first and second supply lines communicate, and a second chamber, wherein a further closure means is provided between the first and second chambers and wherein the first closure means is provided between the second chamber of the first material tank and the second material tank. The additional closure means is thus between the first and second supply lines and the second chamber of the first material tank. With this embodiment it becomes possible to omit the closure means between each of the supply lines and the first material tank. The first chamber of the first material tank is in this embodiment continuously under atmospheric pressure, which is established by the pressure equalization line. The second chamber of the first material tank, which is separated from the first chamber by the further closure means, establishes the pressure charge chamber, into which during operation material can be introduced out of the first chamber when the additional closure means is opened and the first closure means is closed. Following the closing of the additional closure means the material out of the second chamber passes into the second material tank, via which it, conventionally via a conveyance pipe, is brought to the tip of the deep vibrator and from there into the ground.

With this embodiment the amount of material, which is respectively all at once brought to the second material tank and from there extruded to the ground, is determined by the volume of the second chamber, which upon opening of the further charge chamber is completely filled, when the volume of the material present in the first chamber is greater than the maximal volume of the second chamber. Thereby in simple manner the amount of the material already introduced into the ground can be determined.

The first closure means between the first and second material tank and/or the additional closure means between the first and second chamber of the first material tank are preferably provided with slide valves or as the case may be have a slideable closure element.

In order not to overload the bearing surfaces of these slide valves or, as the case may be, slideable closure elements, during opening due to the pressure differential between the first and second material tank and/or between the first and second chambers of the first material tank, in accordance with one embodiment of the invention a first pressure equalizing element is provided between the first and second material tank and second pressure equalizing element is provided between the first and second chamber of the first material tank. The first pressure equalizing element is designed in order, prior to the opening of the first closure means, to bring about a pressure equalization between the second material tank and the first material tank or as the case may be the second chamber of the first material tank, and the second pressure equalizing element is designed in order, prior to opening of the additional closure means between the first and second chamber of the first material tank, to bring about a pressure equalization between these two chambers.

The subject of the present invention is further a process for producing columns of material in the ground according to Claims 16 through 20.

BRIEF DESCRIPTION OF THE DRAWING

The inventive device and the inventive process will in the following be described in greater detail on the basis of illustrative embodiments using figures. The figures show.

BRIEF DESCRIPTION OF THE DRAWING

Figure 1:
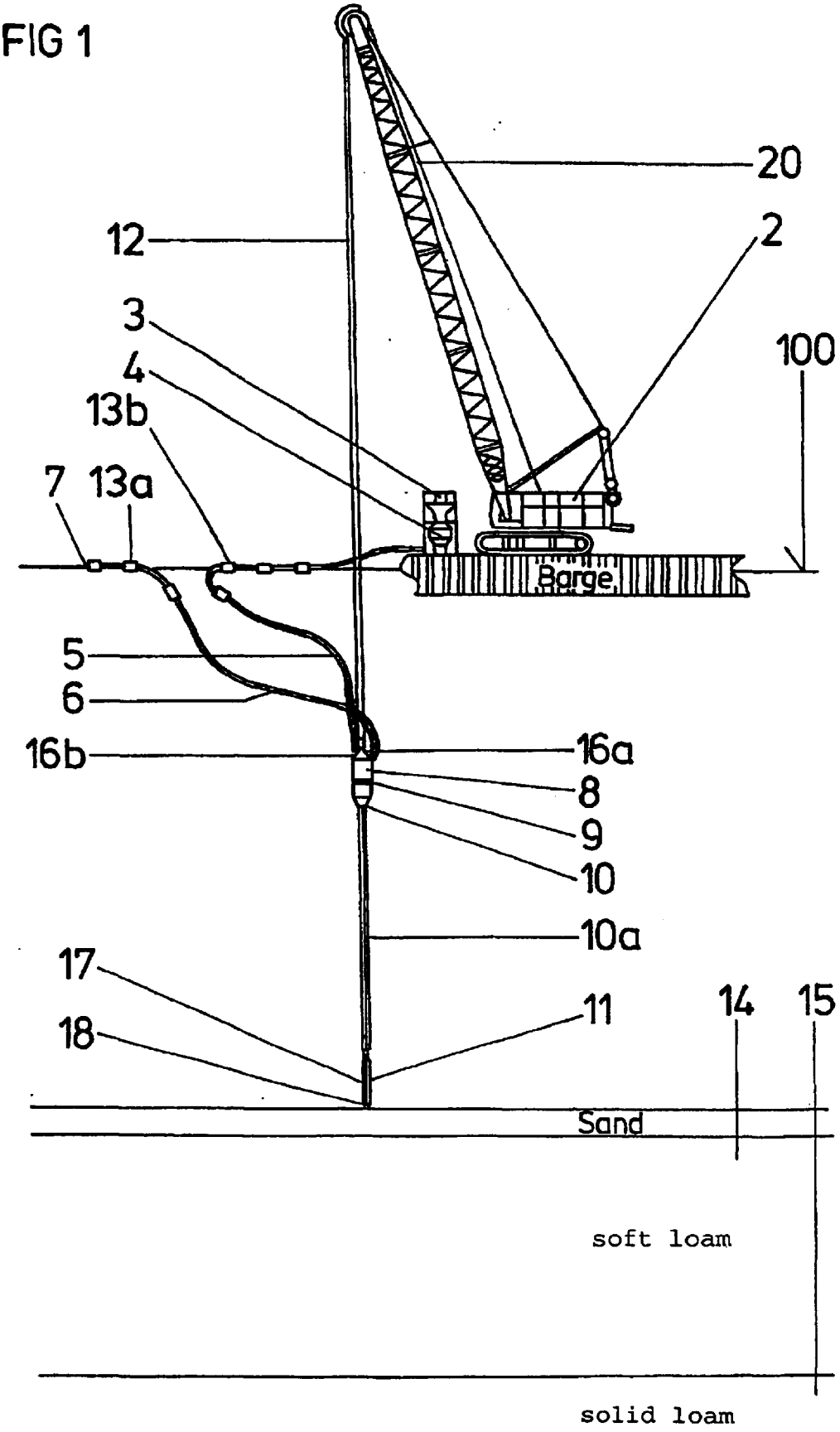
FIG. 1 an inventive device for producing material columns in the ground in overall representation, FIG. 2 a section of the inventive device with a first and second material tank according to a first illustrative embodiment, FIG. 3 a top view of a slideable closure element and the actuating device therefore, FIG. 4 a section of the inventive device with a first and second material tank according to a second illustrative embodiment, FIG. 5 a top view onto a slideable closure element and the actuating mechanism therefore according to a further embodiment.

Unless indicated otherwise, in the figures the same reference numbers refer to the same parts and have the same meaning. FIG. 1 shows in overall view a device for introduction of columns of material, in particular gravel columns, in the ground of water-covered bodies, in particular in the seafloor. This type of column serves for reinforcing a soft ground layer 14 and is driven into a depth generally until reaching a thereunder-lying solid ground layer 15. The reinforcement of the seafloor is necessary for example for construction of drilling platforms with foundations on the seafloor.

In the embodiment according to FIG. 1 the inventive device is hung from the mast 20 of a rope dredge 2 using a rope 12 to be height adjustable, wherein the rope dredge 2 floats on a pontoon 1 upon the surface of the water 100.

The device includes a first material tank 8 and a second material tank 10, wherein between the first and second material tank 8, 10 a first closure means 9 is provided. In the second material tank 10 a conveyance pipe 10*a* is connected directed downwards, on the end of which a deep vibrator 11 is provided, wherein material to be introduced into the ground 14 is supplied to a vibrating tip 18 via a pipe 17.

The first supply line 5 is connected to the first material tank, which line on the end opposite the first material tank 8 is connected to a material reservoir 3 with a pressure tank 4, which in the illustrative embodiment is likewise located upon the pontoon 1. Onto the first material tank 8 there is further connected a second supply line 6 serving as pressure equalizing line, of which the end opposite to the first material tank 8 communicates in this embodiment with the atmosphere above the water surface 100. On this end of the supply line 6 in this embodiment a snorkel 7 is provided, which prevents the entry of water into the supply line 6 and which may be, for example, a ball or float valve.

In order to keep segments of the supply lines 5, 6 on the surface of the water 100, floats 13*a*, 13*b*, which are made for example of Styrofoam or another material with great buoyancy, are provided on the supply lines 5, 6.

As alternative to floats countless other means are conceivable for keeping the end of the pressure equalizing line 6 opposite to the material tank 8 above the water surface. This end can for example be secured to the pontoon above the water surface. In this case a ball valve can be omitted.

Figure 2:
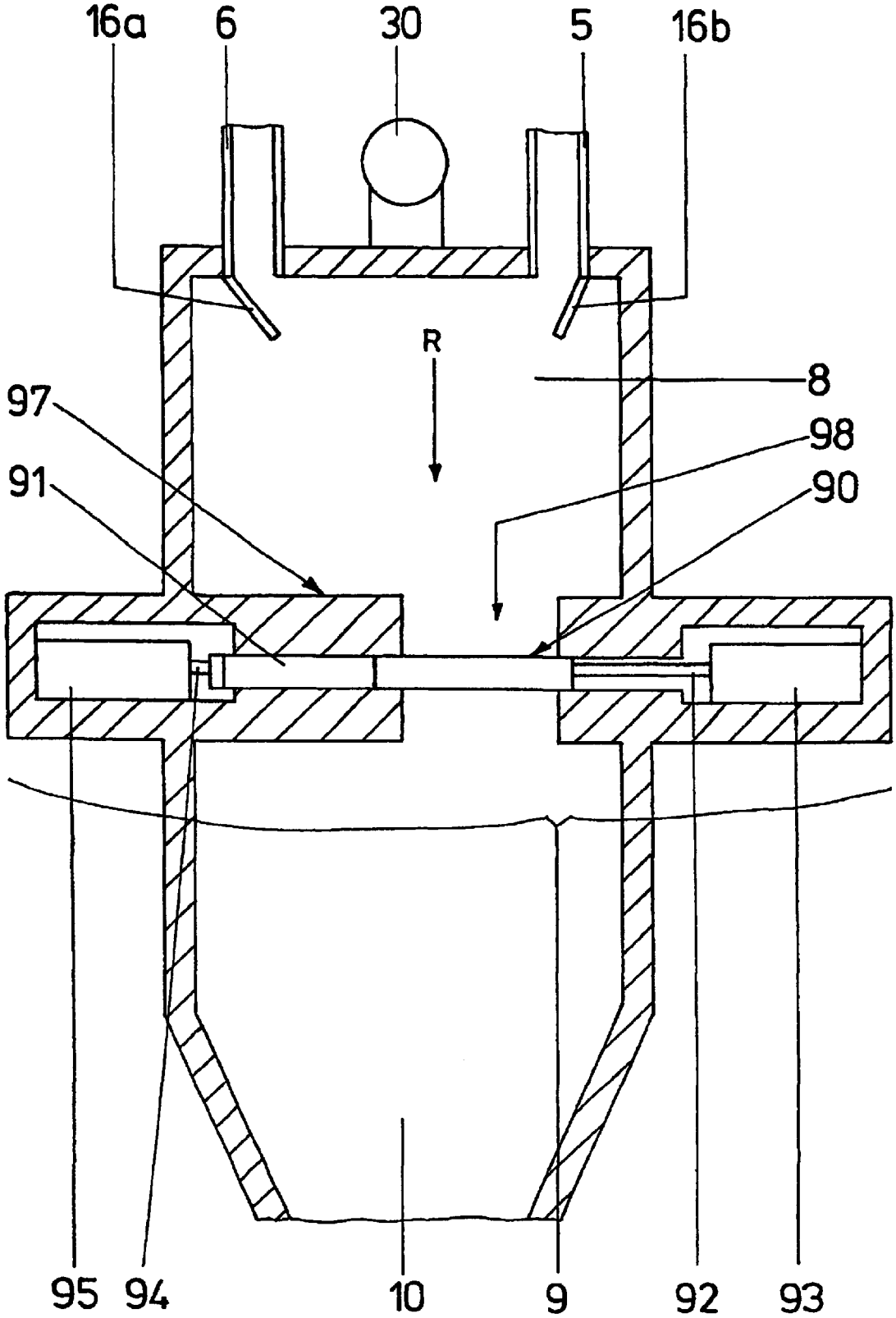

In an embodiment, which is shown in particular in detail in FIG. 2, a second closure means 16*b* is provided between the first supply line 5 and the first material tank 8 and a third closure means 16*a* is provided between the second supply line 6 and the first material tank 8. When the second closure means 16*a* is opened then the second (air) supply line or pressure equalizing line 6 makes possible a pressure equalization of the inside of the first material tank 8 with the atmospheric pressure on the surface of the water 100, at which time the first closure means 9 between the first and second material tanks 8, 10 is preferably closed. When the second closure means 16*b* is open, then the material to be introduced into the ground, for example gravel, can be introduced by the first supply line 5 in the first material tank 8.

Since the first material tank 8 is under atmospheric pressure, the conveyance of the material into the first supply line 5 can occur independent of the depth of the water with the same pressure relationship as would exist on land. This means, that for the production of a suitable conveyor pressure in the supply tank 4 conventional compressors can be used, which are capable of building up a pressure of maximally approximately 7.5 bar in the supply tank 4. If, however, the conveyance pressure of the material would have had also to overcome the water pressure at the depth of the first material tank 8, then expensive special compressors would be necessary for high pressures for conveying the material. Besides this, it is advantageous to convey the gravel in the supply line 5 with as little pressure as possible, since for conveying of gravel a high as possible air flow is necessary, which high air flow is no longer available at high pressures due to the compressibility of air. The existence of atmospheric pressure in the first material tank 8 during the introduction of material is thus particularly. preferred for many reasons.

The water depth at which the inventive device can be used is limited only by the stability of the first and second supply lines 5, 6, which are conventionally in the form of hoses. Preferably hoses are employed, wherein metal spirals are embedded between a rubber jacket and a rubber core, wherein the metal spirals increase the stability of the hose against being collapsed due to water pressure and make possible working depths of greater than 100 meters. In the case of use of special hoses, work depths of 200 meters and more are possible. One hose conventionally employed for conveying gravel is available as model FS3320 from the company Semperit.

FIG. 2 shows in cross-sectional representation a segment of the inventive device, showing the first material tank 8 and the upper area of the second material tank 10. The first and second hoses connect to the upper side of the first material tank and are closeable via first and second closure means 16*b*, 16*a*. These closure means 16*b*, 16*a* are shown in FIG. 2 as flapper valves, but could however be of any other desired design. In the embodiment according to FIG. 2 a closure device 9 is provided between the first and second material tanks, which includes a separating wall 97 with an opening 98, wherein a closure element 90 slideable in the separating wall is provided. The closure element is thus provided to be slideable transverse to the material flow direction R, which direction of flow is defined by the direction of material flowing from the first to the second material tank when the closure means 9 is opened.

Figure 3:
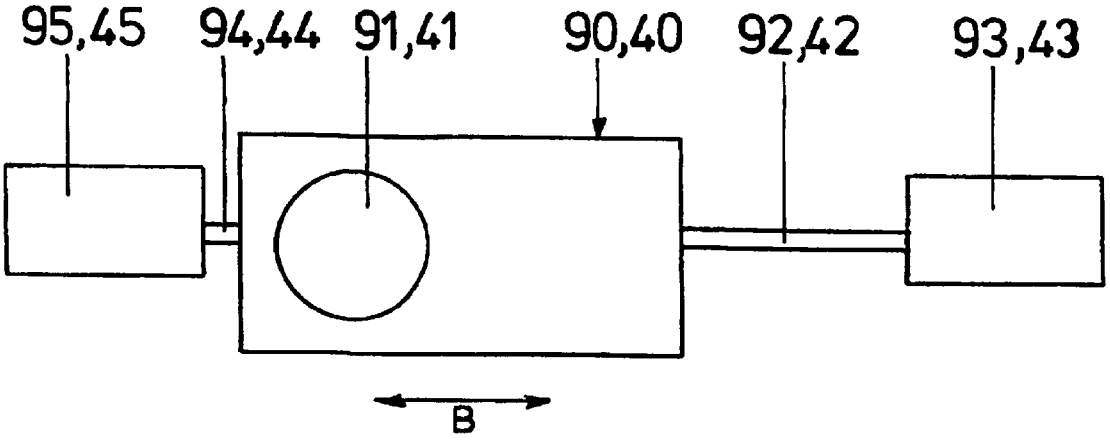

In the closure element is, as can be seen from FIG. 3, square or quadrilateral in top view in the illustrative embodiment and exhibits an opening 91 in one halve. By sliding the closure element 90, the halve without opening can be slid into the opening 98 of the separating wall 97, in order to close this closure means, and alternatively the opening can at least partially be brought into overlap with the opening 98 of the separating wall, in order to open the closure means 9.

The closure element 90 is hydraulically slideable. For this, two hydraulic units 93, 95 are provided in the example, which respectively include one hydraulic cylinder 92, 94 wherein respectively one hydraulic cylinder 92, 94 is connected to one end of the closure element 90.

Figure 5:
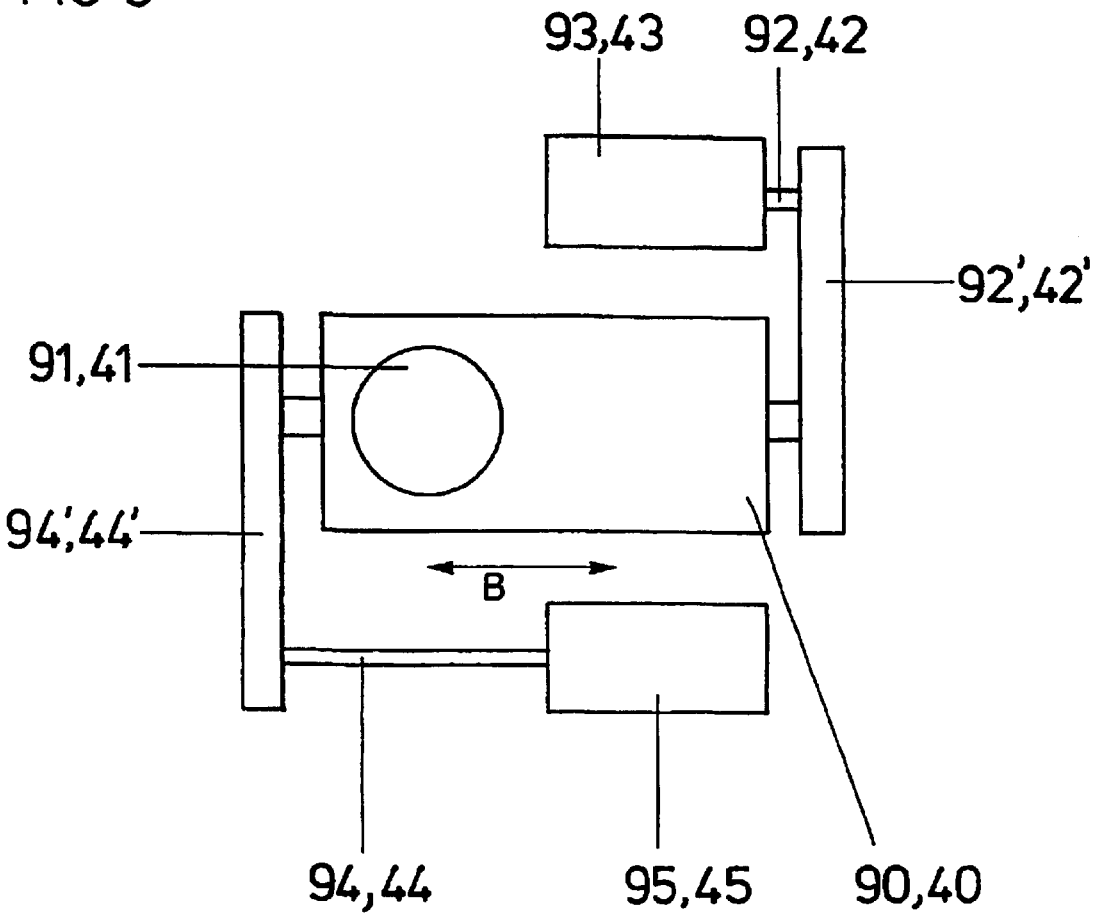

In the example according to FIG. 3 the hydraulic units 93, 95 are aligned for extension along direction of movement B of the closure element 90, 40. FIG. 5 shows in top view a different embodiment, in which the hydraulic units 93, 95 are provided beside and displaced diagonally relative to the movement direction B the closure element 90. Respectively one hydraulic cylinder 92, 94 is coupled to one of the narrow sides of the closure element via a coupling element 92', 94'. In a different, not shown embodiment, the hydraulic units are so designed that their hydraulic cylinders engage on the same narrow side of the closure elements 90.

A process for producing material columns in the ground 14 by means of the device shown in FIG. 2 is described briefly in the following on the basis of the figure. First, with closed first closure means 9 and open second and third closure means 16*b*, 16*a* material under pressure is pumped out of the reservoir 3. 4 via the first supply line 5 into the first material tank 8. Atmospheric pressure exists in the first material tank 8 due to the connection via the second supply line 6 to the water surface 10. A normal pressure for conveying material into the first supply line 5 is approximately 3–6 bar.

Subsequently the second and third closure means 16*b*, 16*a* are closed and thereafter the first closure means 9 is opened in order to bring the material from the first material tank into the second material tank 10 and from there via the conveyor pipe 10*a* and the connecting line 17 to the tip of the deep vibrator 11, where it is injected into the ground and by means of the vibrator 11 is compacted. In the second material tank 10, the thereto connected conveyor pipe 10*a* and the supply pipe 17 there exists a pressure, which is greater than the environmental pressure at the material outlet opening 18 at the tip of the deep vibrator 11, in order to bring about the extrusion of the material. This pressure is produced by means of a compressor which is not shown in detail in the figure, which compressor is connected to the second material tank 10. Preferably this compressor or a second compressor is connected to the first material tank 8, in order to build up a pressure in the first material tank 8 after the closure of the second and third closure means 16*b*, 16*a* towards the supply lines 5, 6 and prior to the opening of the first closure means 9 to the second material tank 10, which pressure corresponds to the higher pressure in the second material tank 10. Thereby on the one hand there is not experienced a drop in pressure in the second material tank during opening of the first closure means 9, and on the other hand the bearing surfaces of the first closure means 9 or as the case may be the closure element 90 according to FIG. 2 are subject to less load during a not existing pressure differential between the first and second material tanks 8, 10. When working at great depths this pressure equalization between the first and second material tanks 8, 10 may in fact be necessary, since with great pressure differentials hydraulic cylinders for moving the slider 9 may in certain cases not provide a sufficient power.

Figure 4:
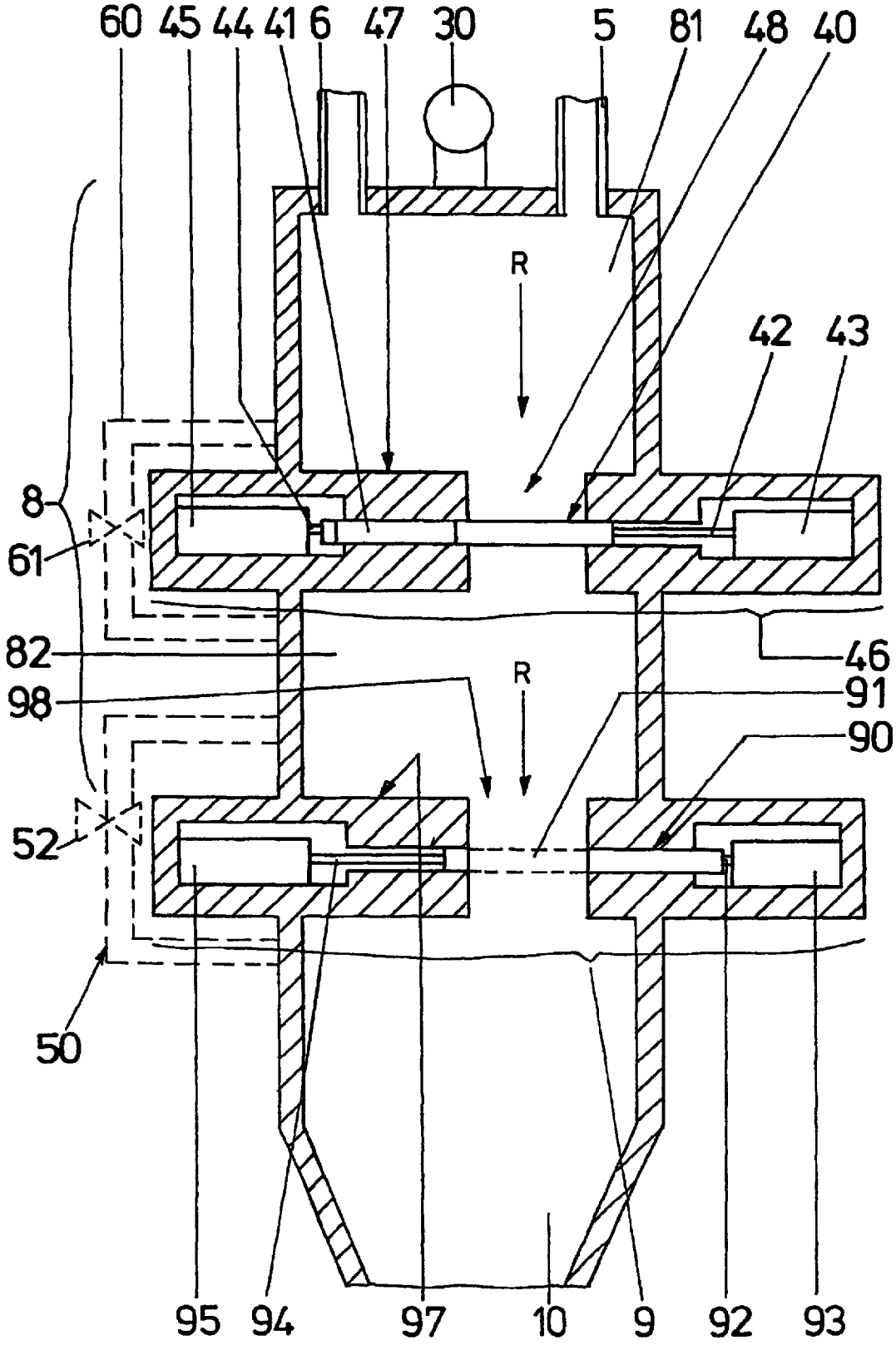

FIG. 4 shows a further embodiment of the inventive device for production of material columns in the ground below aqueous bodies. In this embodiment the first material tank 8 has a first chamber 81, in which the first and second supply lines 5, 6 communicate, and a second chamber, wherein a further closure means 46 is provided between the first and second closure means and wherein the first closure means 9 is provided between the second chamber 82 of the first material tank 8 and the second material tank 10.

The construction of the second closure means 46 is in this shown embodiment the same as the first closure means, of which the design and manner of operation has already been described above in association with FIGS. 2, 3 and 5. The closure means exhibits likewise a separating wall 47 with an opening 48 and a closure element 40 slideable in the separating wall by means of hydraulic lines 43, 42 and 45, 44, and exhibiting an opening 41.

In the illustrative embodiment according to FIG. 4, of which the manner of operation will be described in the following, a designated separate closure means for supply lines 5, 6 can be dispensed with. The function of these closure means which were indicated in FIGS. 1 and 2 with 16*b*, 16*a* is assumed by the additional closure means 46 between the first and second chambers 81, 2.

During operation the first chamber 81, in which atmospheric pressure exists due to the pressure equalizing line, material, in particular sand, gravel or the like is supplied. The material supply can occur uninterrupted and is only limited by the maximal handling or throughput capacity of the first chamber 81. In a subsequent process step the additional closure means 46 is opened with closure of the first closure means 9, in order to introduce material out of the first chamber 81 into the there under lying second chamber 82. The additional closure means 46 remains open preferably so long until the second chamber is completely filled and is then closed.

Following closure of the additional closure means 46 the first closure means 9 is opened, in order to move the material out of the second chamber of the first material tank 8 into the second material tank 10 which is under pressure, and from there into the ground. The amount of material entering into the second material tank following the opening of the second closure means is approximately determined by the volume of the second chamber 82. The volume of this second chamber 82 is preferably smaller than that of the first chamber 81, in order to have available in the first chamber 81 sufficient material for the rapid filling of the second chamber 82 following the opening of the additional closure means. With each opening of the first closure means 9 the same amount of material to be introduced into the ground is supplied to the second material tank 10, which is advantageous in order for the determination at a point in time of the amount of material which has already been introduced into the ground.

Following the supply of material and the closure of the additional closure means 46 there exists in the second chamber atmospheric pressure or at least a pressure, which is less than the pressure in the second material tank. In order not to overload the bearing surfaces of the first closure means 9, in the example according to FIG. 4 the bearing surface of the closure element 90, and the hydraulics, by the existing pressure differential between a second chamber 82 and the second material tank 10, there is preferably provided a pressure equalizing element between the second material tank 10 and the second chamber 82, which in FIG. 4 is essentially schematically represented as a connecting line 50 with a valve 51. Via this pressure equalizing element an equalization of pressure between the second material tank 10 and the second chamber 82 is brought about prior to the opening of the first closure means. The loss of pressure occurring in the second material tank is normally small, since the volume of the second chamber 82 is generally substantially smaller than the second material tank 10. In any case, the pressure in the second material tank 10 is permanently adjusted by the compressor.

Following the opening of the first closure means 9 or as the case may be following the pressure equalization there exists in the second chamber a pressure, which is generally substantially higher than atmospheric pressure. A pressure equalizing element is preferably also provided also between the first and second chamber, which in FIG. 4 is schematically shown as line 60 with a valve 61 and which serves, following the emptying of the second chamber 82 and the closing again of the first closure means 9, to produce a pressure equalization between the first chamber 81 and the second chamber 10, before the closure means 46 is again opened for renewed supply of material into the second chamber 82. This measure reduces the load for the bearing surfaces and the hydraulic mechanism for the closure means 46.

Preferably a device is provided, not shown in greater detail, connected to the hydraulics, which brings about that an actuation, in particular an opening of the closure means, can only occur, when the pressure equalization has already occurred.

The design of the closure means 9, 46 between the first and second material tank 8, 10 or as the case may be between the first and second chamber 81, 82 as closure means with slideable closure elements 90, 40 shown in FIGS. 2 and 4 represents only one possible design of the closure means. Of course various other closure means can be used in association with the invention.

Reference Number List

2 Construction equipment
3, 4 Material reservoir
5 First supply line
6 Second supply line
7 Snorkel
8 First material tank
9 First closure means
10 Second material tank
11 Deep vibrator
12 Rope
13*a*, 13*b* Float
14 Soft ground
15 Solid ground
16*a* Third closure means
16*b* Second closure means
17 Supply line
18 Tip of the deep vibrator
20 Boom
46 Additional closure means
40, 90 Closure elements
41, 91 Openings in the closure elements
42, 44 Hydraulic cylinder
43, 45 Hydraulic units
47, 97 Separating wall
48, 98 Openings
92, 94 Hydraulic cylinder
93, 95 Hydraulic units
100 Water surface
R Material flow direction

We claim:

1. A device for production of columns of material in the ground below a body of water, including:

a first material tank (8), and a second material tank (10) connected with the first material tank, a deep vibrator (11) connected with the second material tank (10), a first supply line (5) for supplying material, connected to the first material tank (8), a second supply line (6) for bringing about a pressure equalization in the first material tank (8), connected to the first material tank (8), a first closure means (9) provided between the first material tank (8) and the second material tank (10).

2. A device according to claim 1, wherein floats (13*a*) are provided in the area of the end of the second supply line (6) opposite to the first material tank (8).

3. A device according to claim 1, wherein at least one additional closure means (16*b*, 16*a*; 46) is provided, which is provided between the first and second supply lines (5, 6) and at least an area (8; 82) of the first material tank (8).

4. A device according to claim 1, wherein a second closure means (16*b*) is provided between the first material tank (8) and the first supply line (5) and a third closure means (16*a*) is provided between the second supply line (6) and the first material tank (8).

5. A device according to claim 1, wherein the first material tank (8) includes a first chamber (81), with which the first and second supply lines (5, 6) communicate, and a second chamber (82), wherein a further closure means (46) is provided between the first and second chamber (80, 81) and wherein the first closure means (9) is provided between the second chamber (82) of the first material tank (8) and the second material tank (10).

6. A device according to claim 1, wherein a material supply device (3, 4) is connected to the first supply line (5) on the end opposite the first material tank (8).

7. A device according to claim 1, which include a compressor connected to the second material tank (10).

8. A device according to claim 7, in which the compressor is also connected to the first material tank (8).

9. A device according to claim 1, in which the first and second supply lines (5, 6) are designed for conveying under pressures of less than 7.5 bar.

10. A device according to claim 1, in which the third closure means (9) includes a closure element (90), which is mounted slideable transverse to the direction (R) of material flowing from the first to the second material tank (8, 9).

11. A device according to claim 10, in which the first closure means between the first and second material tank (8, 10) includes a separating wall (97) with an opening (98), wherein the closure element (90) is mounted slideable in the separating wall (97).

12. A device according to claim 10, in which the closure element (90) is plate shaped and includes a closed area and an area with an opening (91), wherein the closure element (90) is mounted such that the opening (98) can be brought to at least partially overlap with the opening of the separating wall for opening the closure means (9).

13. A device according to claim 1, in which the additional closure means (46) includes a closure element (40), which is mounted slideable transverse to a direction of flow (R) of material from the first chamber (81) to the second chamber (82) of the first material tank (8).

14. A device according to claim 13, in which the additional closure means between the first and second chamber (81, 82) of the first material tank (8) includes a separating wall (47) with an opening (48), wherein the closure element (40) is mounted slideable in the separating wall (47).

15. A device according to claim 13, in which the closure element (90) is plate shaped and includes a closed area and an area with an opening (91), wherein the opening (98) can be brought into at least partial overlap with the opening of the separating wall for opening of the closure means (46).

16. A process for producing columns of material in the ground, including:

providing a device having a first material tank (8) and a second material tank (10) connected with the first material tank, a deep vibrator (11) connected with the second material tank (10), a first supply line (5) for supplying material connected to the first material tank (8), a second supply line (6) for bringing about a pressure equalization in the first material tank (8) connected to the first material tank (8), and a first closure means (9) provided between the first material tank (8) and the second material tank (10), supplying material to the first material tank (8) via the first supply line (5), producing pressure in the second material tank (10), opening the first closure means (9) between the first and second material tank (8, 10).

17. A process according to claim 16, in which the device includes a second closure means (16*b*) between the first supply line (5) and the first material tank (8) and a third closure means (16*a*) between the second supply line (6) and the first material tank (8), wherein the second and third closure means (16*a*, 16*b*) are closed following the supply of material and prior to the opening of the first closure means.

18. A process according to claim 17, in which following the closure of the first and second closure means (16*a*, 16*b*) and prior to the opening of the third closure means (9) a pressure is established in the first material tank (8).

19. A process according to claim 17, in which the pressure produced in the first and/or second material tank (8, 10) is greater than the water pressure at the material outlet opening at a tip (18) of the deep vibrator (11).

20. A process according to claim 16, in which the first material tank (8) includes a first chamber (81), into which the first and second supply lines (5, 6) communicate and a second chamber (82) and a closure means (46) provided between the firs and second chambers (81, 82), wherein the process includes the following additional steps:

following the supply of material into the first chamber (81): opening the additional closure means (46) with closed first closure means (9), in order to supply material to the second chamber (82), closing the additional closure means (46) prior to the opening of the first closure means (9).

* * * * *